US008015741B2

(12) United States Patent
Hooks

(10) Patent No.: US 8,015,741 B2
(45) Date of Patent: Sep. 13, 2011

(54) CHAMBERING AND TRIGGER SAFETY DEVICE FOR HANDGUN

(76) Inventor: Douglas Hooks, Martin, TN (US)

( * ) Notice: Subject to any disclaimer, the term of this patent is extended or adjusted under 35 U.S.C. 154(b) by 169 days.

(21) Appl. No.: 12/505,891

(22) Filed: Jul. 20, 2009

(65) Prior Publication Data

US 2011/0010978 A1 Jan. 20, 2011

(51) Int. Cl.
*F41A 17/46* (2006.01)
*F41A 35/00* (2006.01)

(52) U.S. Cl. ..... 42/70.01; 42/70.06; 42/70.11

(58) Field of Classification Search ..... 42/70.01, 42/70.06, 70.11
See application file for complete search history.

(56) References Cited

U.S. PATENT DOCUMENTS

| | | | | | |
|---|---|---|---|---|---|
| 835,349 | A | * | 11/1906 | Deming | 42/70.08 |
| 2,538,265 | A | * | 1/1951 | Paston | 224/176 |
| 3,743,147 | A | * | 7/1973 | Wilczynski | 224/199 |
| 3,848,270 | A | * | 11/1974 | Rand | 2/311 |
| 4,047,651 | A | * | 9/1977 | McMullen | 224/168 |
| 4,392,318 | A | | 7/1983 | Daniels | |
| 4,395,837 | A | * | 8/1983 | Durnal | 42/70.11 |
| 4,807,512 | A | | 2/1989 | Johansson | |
| 4,825,576 | A | | 5/1989 | Troncoso | |
| 4,852,286 | A | | 8/1989 | Troncoso | |
| 4,914,846 | A | | 4/1990 | Shivers | |
| 4,945,665 | A | | 8/1990 | Nelson | |
| 4,961,277 | A | * | 10/1990 | Rosenbaum | 42/70.11 |
| 5,033,218 | A | | 7/1991 | Nelson | |
| 5,075,994 | A | | 12/1991 | Nishioka | |
| 5,261,177 | A | * | 11/1993 | Armstrong | 42/70.08 |
| 5,458,267 | A | * | 10/1995 | Curtis et al. | 224/675 |
| 5,768,819 | A | * | 6/1998 | Neal | 42/96 |
| 5,852,829 | A | * | 12/1998 | Relaford | 2/338 |
| 5,910,002 | A | | 6/1999 | Hunter | |
| 5,955,696 | A | | 9/1999 | Meller | |
| 6,561,073 | B1 | | 5/2003 | Hogmoe | |
| 6,568,117 | B2 | * | 5/2003 | Weinraub | 42/70.11 |
| 6,694,659 | B2 | * | 2/2004 | Olsen | 42/70.11 |
| 7,266,921 | B2 | | 9/2007 | McClellan | |

* cited by examiner

*Primary Examiner* — Bret Hayes
(74) *Attorney, Agent, or Firm* — Morriss O'Bryant Compagni, P.C.

(57) ABSTRACT

A device for assisting in the chambering of a handgun that can also serve as a safety device for preventing unwanted firing of the handgun is disclosed. The device comprises a slide pull that includes an elongate laterally flexible structure having a first end configured for being releasably coupled to a first side of a slide of a handgun and a second end configured for being releasably coupled to a second side of the slide. A trigger restraint is coupled to the slide pull near a mid-portion thereof. In a first position, the slide pull is configured for being grasped by a user in order to chamber a bullet. In a second position, the trigger restraint is positioned relative to the trigger to prevent movement of the trigger that would otherwise cause the weapon to fire.

20 Claims, 7 Drawing Sheets

CHAMBERING AND TRIGGER SAFETY DEVICE FOR HANDGUN

BACKGROUND OF THE INVENTION

1. Field of the Invention

The present invention relates generally to gun safety devices and more specifically to a device for assisting in the chambering of the weapon that also serves as a trigger safety device.

2. Description of the Related Art

Safety devices to prevent accidental firing of handguns have been known for decades and have been designed with a variety of configurations. One type of such a safety device is a trigger cover that attaches to a handgun and covers the entire trigger guard to prevent access to the trigger. Often, such devices are attached by various fasteners, such as pins or screws, and require a special tool to release the device from the trigger. U.S. Pat. No. 5,075,994 to Nishioka discloses a trigger cover including a locking device that is unlocked using a tool such as an Allen wrench or a key.

Other types of handgun safety devices utilize a locking clamp that holds the trigger in a depressed position thereby preventing the weapon from transitioning to a firing condition. The disadvantage of this type of device is that it must be unlocked with a key if firing is necessary. Although such devices may be effective in preventing a child from accidentally firing the gun, it may also inhibit proper use in an emergency situation while searching for a key to release the safety device. In addition, such devices are relatively cumbersome to remove, especially in an emergency situation where quick removal of the safety device may be desired. U.S. Pat. Nos. 4,945,665 and 5,033,218 to Nelson disclose a gun trigger safety devices including a block made of a resilient material that is molded to conform to the inner perimeter of a gun trigger guard. The trigger is held in a depressed state when the block is inserted.

Conversely, U.S. Pat. Nos. 4,852,286 and 4,825,576 to Troncoso et al., disclose detachable gun trigger safety devices configured to span the space between a gun trigger and the rear portion of the trigger guard. The safety device forces the trigger to stay in a forward position to prevent the trigger from rearward movement and subsequent firing of the gun.

U.S. Pat. Nos. 4,945,665 and 5,033,218 to Nelson both disclose quick-release gun trigger safety devices including a block made of a resilient material that is molded to conform to the inner perimeter of a gun trigger guard. The trigger is held in a depressed state when the block is inserted. The block has flexible flanges formed on both sides that partially extend around the trigger guard and the depressed trigger to hold the block in place. U.S. Pat. No. 5,910,002 to Hunter discloses a gun trigger safety device for double action revolvers and holds the trigger in an unfireable position. U.S. Pat. No. 7,266,921 to McClellan discloses another trigger guard.

There are also devices known in the art configured to assist in the loading or chambering of a bullet. U.S. Pat. No. 6,561,073 to Høgmoe discloses a device for carrying, loading and cocking a firearm. Likewise, U.S. Pat. No. 4,807,512 to Johansson discloses a sling for cocking the bolt of a handgun. Such devices, however, are not readily adaptable to any hand gun and do not prevent inadvertent discharge of the weapon.

Thus, it would be advantageous to provide a device for a handgun that operates as both a safety device to prevent unwanted firing of the weapon and also assist the user in loading a bullet into the firing chamber of the weapon.

SUMMARY OF THE INVENTION

Accordingly, the present invention provides a device for assisting in the chambering of a handgun and that can also serve as a safety device for preventing unwanted firing of the handgun. The slide pull of the present invention includes an elongate laterally flexible structure having a first end configured for being releasably coupled to a first side of a slide of a handgun and a second end configured for being releasably coupled to a second side of the slide. The elongate member forms a loop extending away from the handgun and is configured for grasping by a user in order to pull the slide of the handgun while resisting movement of the handgun. Doing so causes a bullet to be chambered in the firing chamber of the handgun.

In one embodiment, a trigger restraint is coupled to the slide pull near a mid-portion thereof. The trigger restraint prevents movement of the trigger that would otherwise cause the weapon to fire. The trigger restraint is comprised of a rigid member coupled to the slide pull.

In another embodiment, the slide pull comprises a pair of elongate members, each having first ends pivotally and releasably coupled to a respective side of the slide of the handgun. The trigger restraint is coupled between the second ends of the pair of elongate members.

In yet another embodiment, the slide pull is attached to the slide of the handgun with a pair of releasable snaps, each having a first portion attached to a respective side of the slide of the gun and a second portion attached to a respective end of the slide pull.

In another embodiment, the trigger restraint comprises a pouch formed in the slide pull that houses rigid member therein. The rigid member, when positioned behind the trigger, prevents the trigger from being moved in a manner that will cause the weapon to fire.

In still another embodiment, the trigger restraint comprises a structure having a front side defining a first recess for receiving a portion of the trigger and a back side defining a second recess for receiving a portion of the grip of the gun.

Other features of the invention are set forth in the appended claims. Although the invention is illustrated and described herein as embodied in a chambering and safety device for a semi-automatic hand gun, the invention is not intended to be limited to the details shown, since various modifications and structural changes may be made therein without departing from the spirit of the invention and within the scope and range of equivalents of the claims. The construction of the invention, however, together with additional features and advantages thereof will be best understood from the following description of specific embodiments when read in connection with the accompanying drawings.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION OF THE ILLUSTRATED EMBODIMENTS

Figure 1:
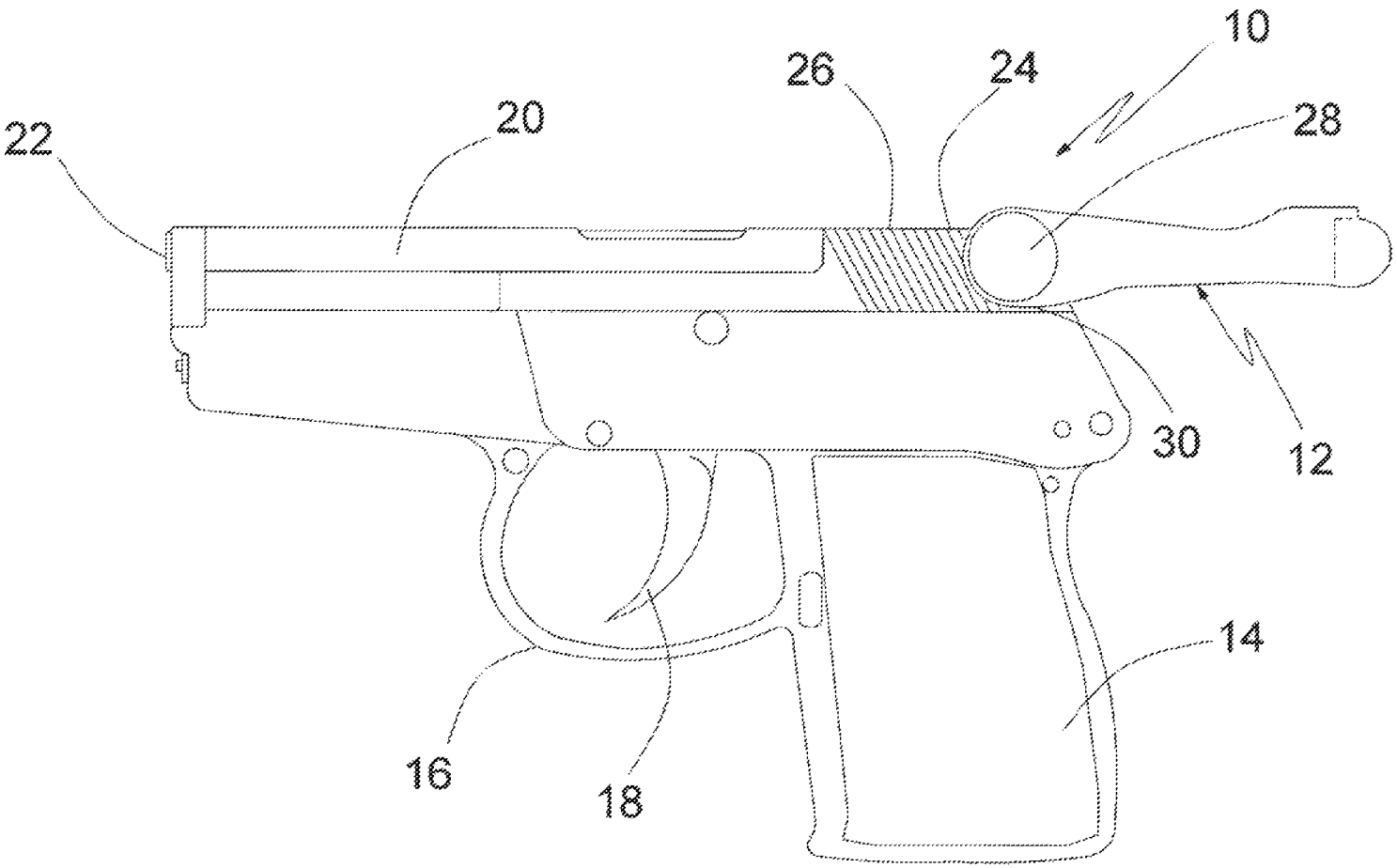
FIG. 1 is a side view of a first embodiment of a handgun safety device in accordance with the principles of the present invention attached to a handgun.

FIG. 1 illustrates a handgun, generally indicated at 10, to which a safety device 12 is attached. The handgun is a semi-automatic pistol, such as a KEL-TEC pistol sold by KEL-TEC CNC, Inc. of Cocoa, Fla. The handgun includes a grip 14, a trigger guard 16, a trigger 18, a slide 20 and a barrel 22. The safety device 12 is pivotally coupled to the slide 20 proximate the proximal end 24 thereof. In order to load a bullet into the firing chamber (not visible) of the handgun 10, the user must pull the slide 20 in a rearward direction. This causes a bullet contained in the magazine (not visible) located in the grip 14 to be chambered and also cocks the gun so as to load the firing pin (not visible) of the handgun 10. Typically, a user must grasp the slide 20 near the proximal end 24 as by gripping the sides of the slide 20 between the thumb and forefinger. Gripping texturing 26 in the form of angled ridges are provided on the slide 20 to assist the user in grasping the slide 20. Unfortunately, the force required to pull the slide 20 in order to properly load and cock the handgun 10 is difficult for some, such as the elderly whose gripping strength is diminished by arthritis or by female users that may have a light gripping strength.

Accordingly, the safety device, generally indicated at 12, of the present invention is attached to the slide 20 and provides a slide pull that can be easily grasped by the user in order to chamber the handgun 10. The safety device 12 is removably attached to the slide 20 via releasable fasteners, such as metal snaps, with a snap 28 attaching an end, such as end 30 of the safety device 12 to each side of the slide 20.

Figure 2:
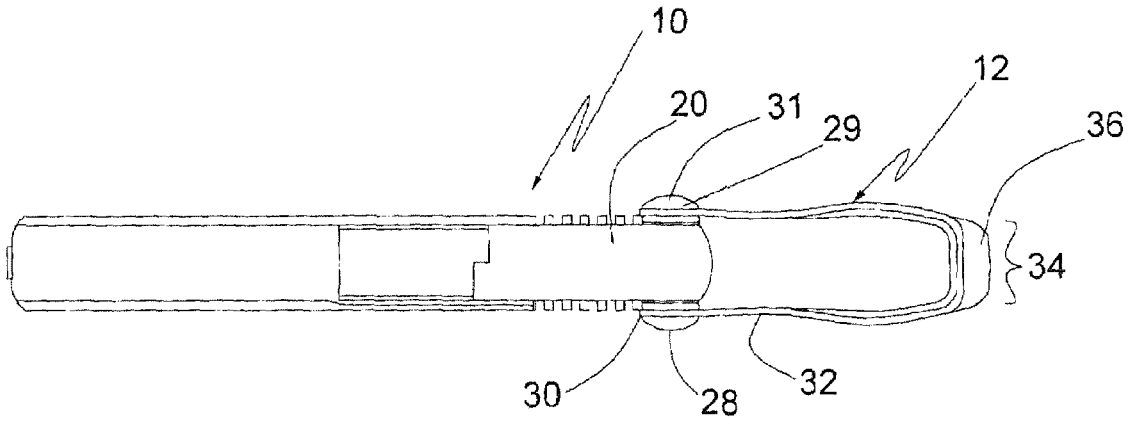
FIG. 2 is a top view of the safety device illustrated in FIG. 1.

As shown in FIG. 2, the safety device 12 includes an elongate member that has a first end 30 attached to one side of the slide 20 and a second end 31 attached to an opposite side of the slide 20. The elongate member 32 may be comprised of a flat section of a flexible material, such as leather strap or long section of rubber or plastic, having holes (not visible) provided proximate the ends 30 and 31 for receiving fasteners 28 and 29, respectively. The elongate member 32 is provided with a thicker mid portion 34 that may be formed by folding a portion of the elongate member 32 along its length to form a pouch 36. A rigid member (not visible), such as a cylindrically shaped elongate member, is inserted and held within the pouch 36.

Figure 3:
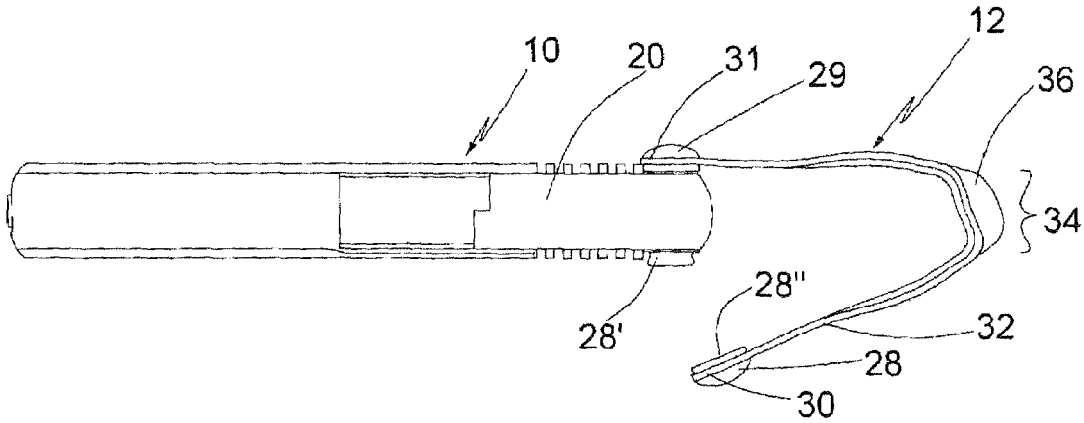
FIG. 3 is a top view of the safety device illustrated in FIGS. 1 and 2 in a partially released position.

As shown in FIG. 3, the safety device 12 may be selectively removed from the handgun 10 on one or both sides of the handgun 10. The safety device 12 is held to the slide 20 by releasable fasteners 28 and 29, such as metal snaps. The fasteners 28 and 29 include a male portion, such as male portion 28' that is fixedly attached to the slide 20 as with a threaded fastener or other means known in the art. The female portion 28" is fixedly attached to the end 30 of the elongate member 32. The opposite end 31 of the safety device is similarly configured and attached to the slide 20. In this illustration, the fastener 28 is in an open or unsnapped position, while the fastener 29 is in a closed or snapped position. With the male portions, such as male portion 28', of both fasteners 28 and 29 attached to the slide 20 and the elongate member 32 completely removed, the male portions provide gripping protuberances on the sides of slide 20 to assist a user from chambering the handgun 10 even with the rest of the safety device 12 removed. Thus, a user gains an added benefit to the attachment of the safety device 12 to the handgun 10 even if the elongate portion 32 that forms a loop for grasping has been removed.

Figure 4:
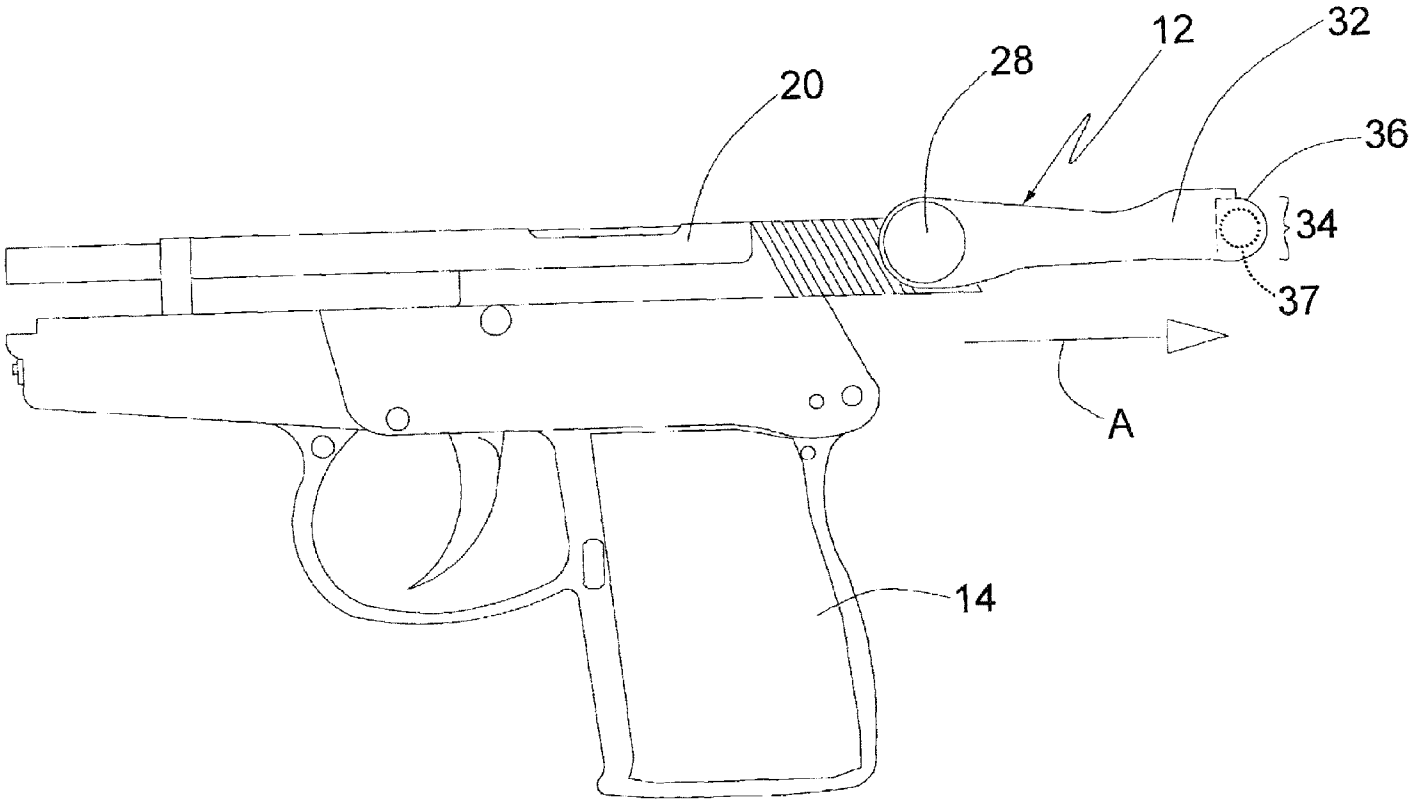
FIG. 4 is a side view of the safety device illustrated in FIG. 1 in which the slide of the handgun has been pulled.

As further shown in FIG. 4, the fasteners 28 and 29 provide strong resistance to forces applied when pulling the elongate member in a direction, as shown by arrow A, substantially parallel to the longitudinal axis of the slide 20 yet are relatively easily released from the slide 20 when a force is applied to the fasteners in a direction transverse to the longitudinal axis of the slide 20. This allows a user to grasp the safety device 12 proximate the mid portion 34 and pull the safety device 12 by pulling against the grip 14 with the opposite hand so as to cause the slide 20 to move toward the user and chamber the handgun 10 without causing the safety device 12 to disconnect from the slide 20. Because the mid portion 34 includes the pouch 36 which is sewn around a rigid member 37, the user can pull on the pouch 36 with one or two fingers with the rigid member 37 providing lateral support along the elongate member 32 at the mid-portion 34. When the user wishes to remove the safety device 12 from the handgun 12 or to reposition the safety device 12 to prevent inadvertent firing of the handgun 12, as will be described in more detail herein, the user can simply unsnap one or both ends of the elongate member 32 from the slide 20 as shown in FIG. 3.

Figure 5:
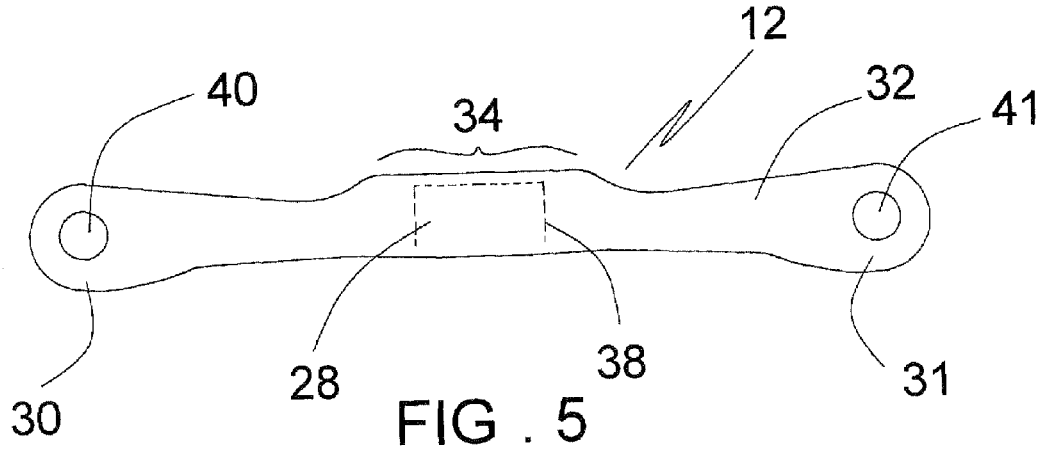
FIG. 5 is a side view of the safety device illustrated in FIG. 1.
Figure 6:
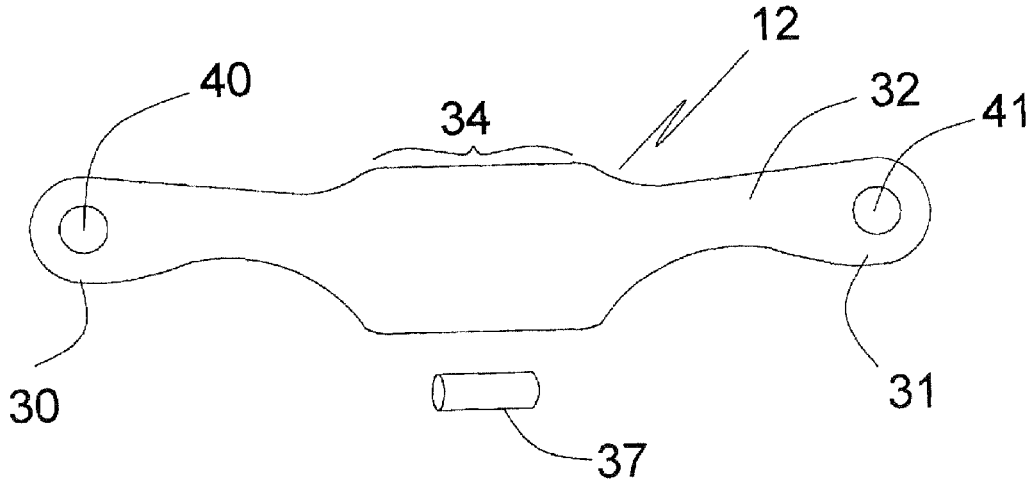
FIG. 6 is a side view of the safety device in an unassembled state illustrated in FIG. 5.

Referring to FIG. 5 and FIG. 6, the safety device 12 includes the elongate member 32 that forms the pouch 28 proximate the mid-portion 34. Thus, the elongate member 32 has a wider mid-portion 34 that can be folded upon itself and attached to itself as with stitching 38. Of course, other methods of forming a pouch, such as by adhesive attachment, are contemplated to be within the scope of the invention. Prior to folding and stitching, the rigid member 37 is positioned against the elongate member 32 within the mid-portion 34 so that when folded the formed pouch 28 contains the rigid member. The rigid member 37 is illustrated as having a cylindrical shape, but could be of any cross-sectional shape. Proximate the ends 30 and 31 of the elongate member, holes 40 and 41 are provided for receiving the fasteners previously described.

Figure 7:
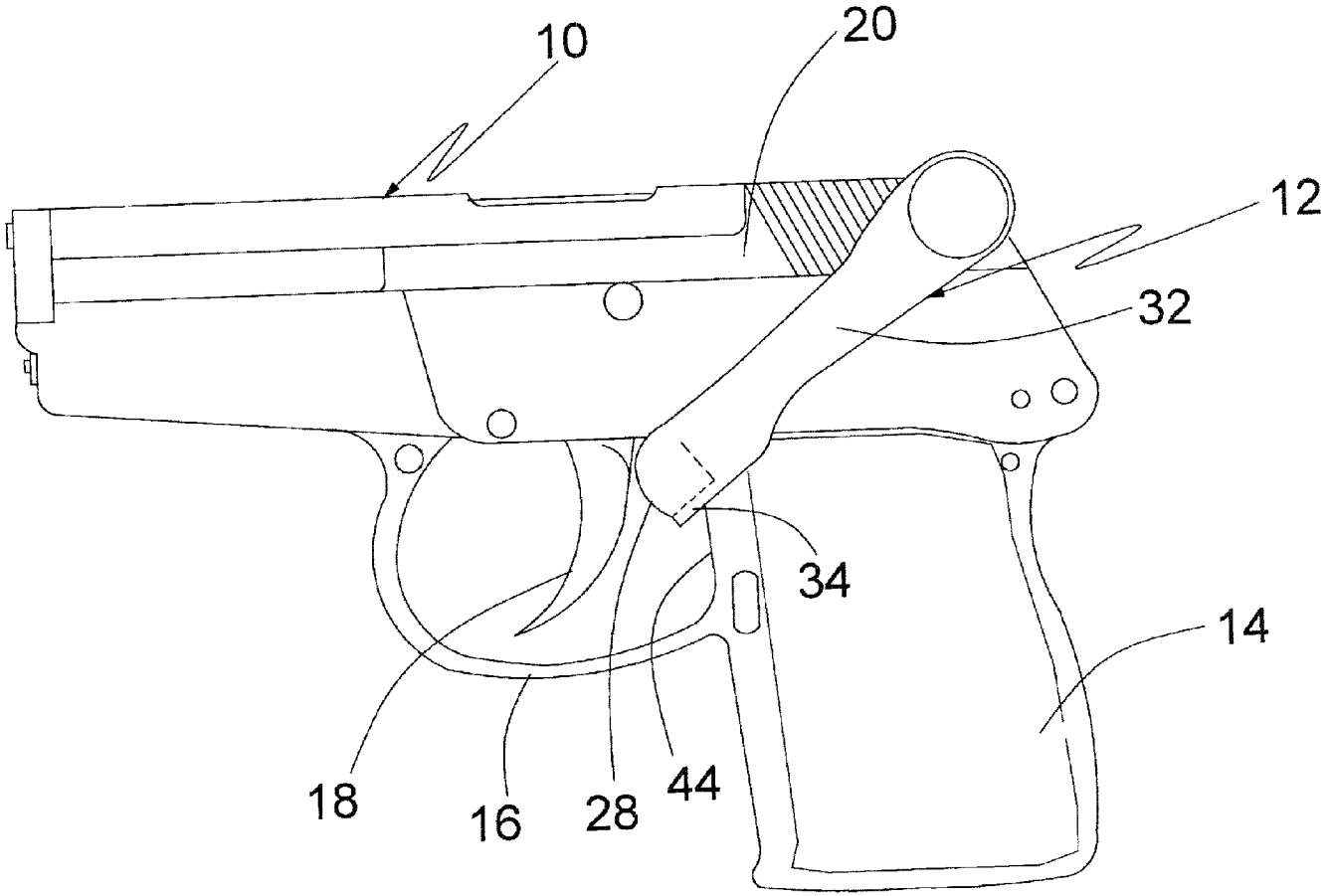
FIG. 7 is a side view of the safety device illustrated in FIG. 1 in a trigger restraining position.

As shown in FIG. 7, the safety device 12 can be moved from a first position used to chamber the weapon 10 to a second position wherein the mid-portion of the safety device 12 resides between the trigger 18 and the grip 14 at a location within the trigger guard 16 so as to be wedged between the trigger 18 and the front side 44 of the grip 14. The rigid member (not visible) contained within the pouch 28 prevents the trigger 18 from being moved toward the grip 14 and thus prevents the handgun 10 from being fired. It is sometimes the case that a user desires to have the handgun ready to be fired with a bullet loaded in the firing chamber, but wants to temporarily prevent the weapon from being inadvertently fired. The user also desires, however, a quick and easy way to enable the weapon to be fired. The safety device 12 prevents the trigger 18 from being pulled that would cause the weapon 10 to be fired when it is in a "trigger locked" position, but can be easily removed to allow the user to pull the trigger 18 to fire the weapon 10. To do so, the use would simply unsnap one side of the safety device 12 from the slide 20, pull the strap 32 to the unreleased side of the safety device 12 still attached to the slide 20 to move the pouch 28 from behind the trigger 18 to allow the trigger 18 to be pulled.

Figure 8:
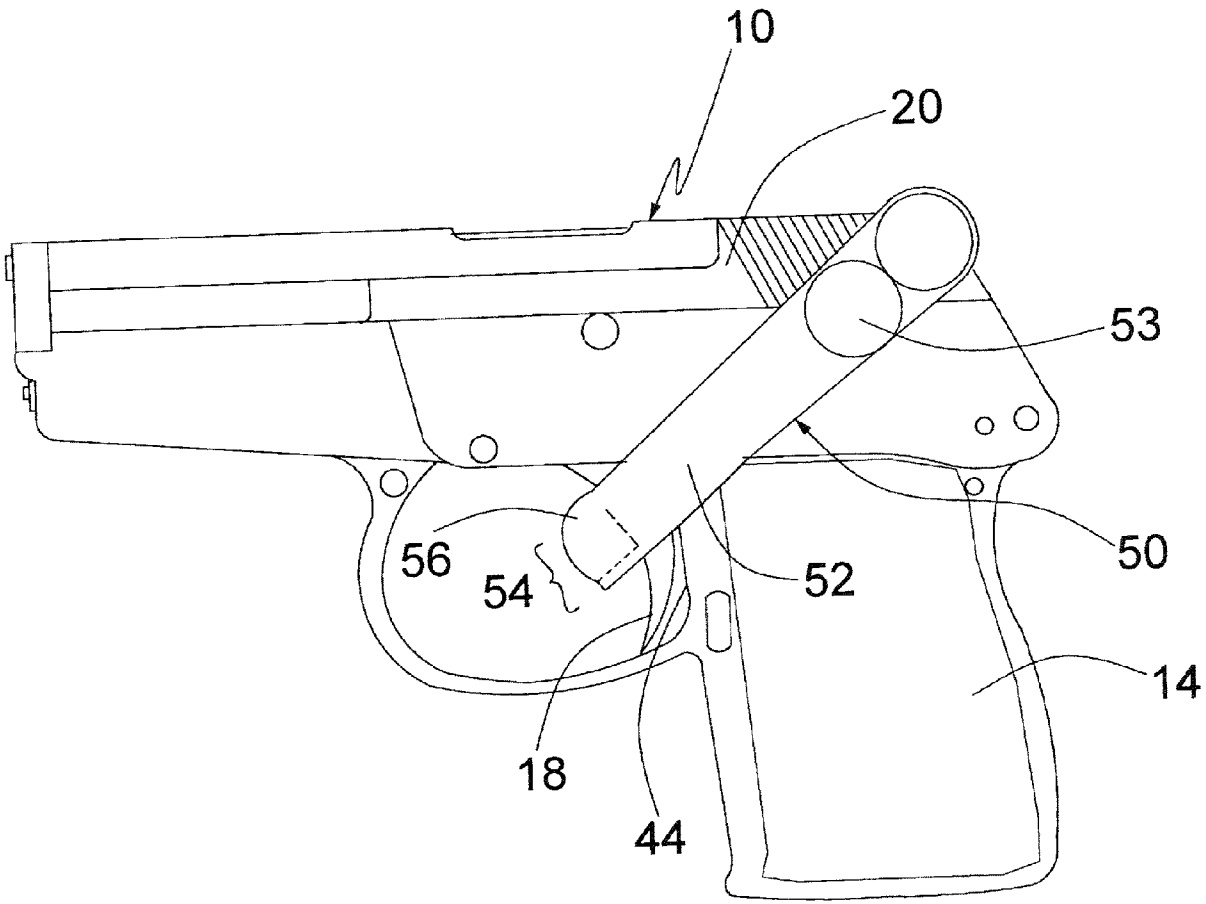
FIG. 8 is a side view of a second embodiment of a handgun safety device in accordance with the principles of the present invention attached to a handgun.

As shown in FIG. 8, it is further contemplated according to the present invention to provide a safety device 50 that is similar in configuration to the safety device 12 previously described, but that can be used to hold the trigger 18 of the handgun 10 in either a forward position as previously shown and described or a rearward position as shown in FIG. 8. The elongate strap 52 is slightly lengthened along one side so as to allow the strap 52 to wrap around and in front of the trigger 18 so as to hold the trigger in a rearward position proximate the front face 44 of the grip 14. In this position, the weapon 10 is prevented from being loaded with a bullet in the firing chamber. With the trigger 18 retracted, the weapon is also prevented from being fired. The strap 52 thus provides a restraint to the slide from being pulled in order to chamber a bullet. As further illustrated, a second fastener 53 is provided so that the user can also use the safety device to position the mid-portion 54 of the safety device 50 behind the trigger 18 as previously described. The second fastener 52 thus removes any slack or play in the strap 52 when the pouch 56 is positioned between the trigger 18 and the front face 44 of the grip. Thus, the safety device 50 can be used in three positions: 1) A first position (as previously shown and described) in which the safety device 50 is positioned behind the weapon 10 to provide a slide pull for the weapon 10; 2) a second position (as previously shown and described) in which the safety device 50 is positioned with the mid-portion 54 located between the trigger 18 and the front face 44 of the grip 14; and 3) in a third position as shown in which the mid-portion 54 is positioned in front of the trigger 18 to hold the trigger 18 in a fully retracted position so as to prevent movement of the trigger 18 or the slide 20 thus preventing loading or firing of the weapon 10.

Figure 9:
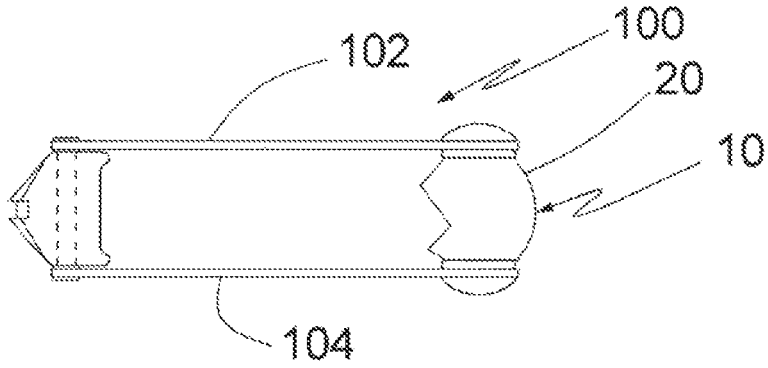
FIG. 9 is a partial top view of a third embodiment of a handgun safety device in accordance with the principles of the present invention attached to a handgun.
Figure 10:
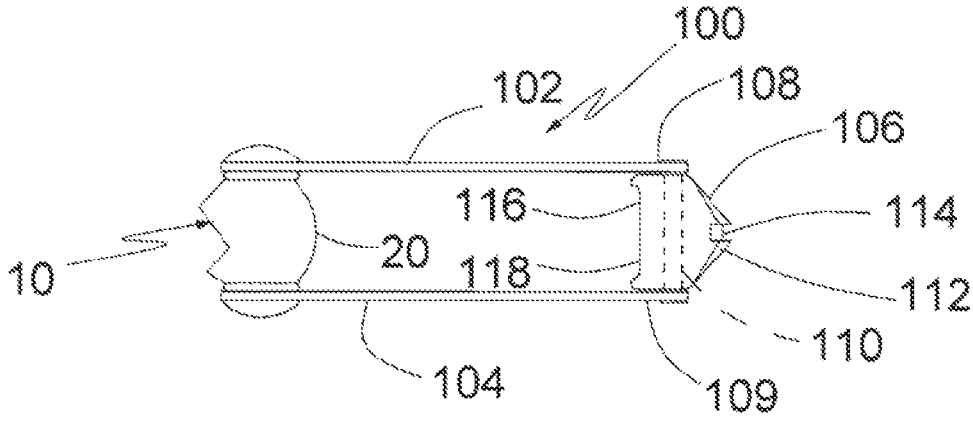
FIG. 10 is a partial top view of the handgun safety device illustrated in FIG. 9 oriented in a slide pulling position.
Figure 11:
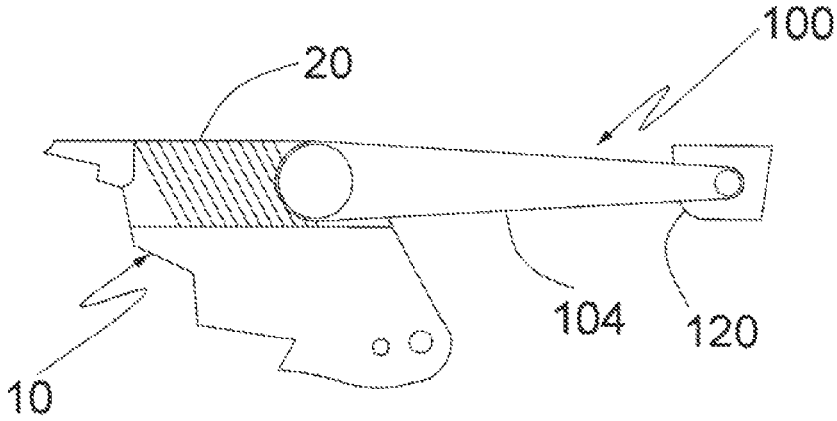
FIG. 11 is a partial side view of the handgun safety device illustrated in FIG. 10.

As illustrated in FIGS. 9, 10 and 11, a safety device 100 may be comprised of individually formed components that are coupled together in a manner that provides a selectively releasable safety device that can be employed as a slide pull (as shown in FIGS. 10 and 11) or as a trigger restraint (as shown in FIG. 9) for a handgun. The safety device 100 is coupled to the handgun 10 (only partially shown) in a manner similar to the other embodiments previously shown and described. The safety device 100, however, is comprised of a pair of longitudinally extending members 102 and 104 that are pivotally coupled to the slide 20 of the handgun 10. The members 102 and 104 are formed from a flexible but longitudinally strong material, such as leather, suitable fabrics, rubber or plastics. A trigger hold 106 is attached to and between the ends 108 and 109 of the members 102 and 104, respectively. The trigger hold 106 may be formed from machined metal such as steel or aluminum, or from injection molded plastic. An elongate fastener member 110 is disposed through the trigger hold 106 to attach the trigger hold 106 to the members 102 and 104.

As further illustrated, the trigger hold 106 is contoured to fit within the space defined between the back side of the trigger 18 and the front face 44 of the grip 14 (see FIG. 7). In addition, the trigger hold 106 has a front side 112 defining a channel 114 for receiving the trigger 18 therein and a rear side 116 defining a rear channel 118 for receiving the front face 44 of the grip 14. As such, which properly positioned, the trigger hold 106 properly seats itself between the trigger 18 and the grip 14 in order to maintain its position and to thus wedge the trigger 18 away from the grip 14. The trigger hold also has a top contour 120 that substantially matches the inside curvature of the handgun 10 adjacent the back side of the trigger 18 so as to properly seat itself therein. As shown in FIGS. 10 and 11, when the safety device 100 is in a position to be used as a slide pull as previously described, the rear side 116 is positioned away from the user so as to provide a relatively flat surface that the user can easily and comfortably grasp when pulling.

Those of ordinary skill in the art will realize that the following description of the present invention is illustrative only and not in any way limiting. Other embodiments of the invention will readily suggest themselves to such skilled persons. Thus, it would be apparent to those skilled in the art that some other components and modifications to such components may be employed in a manner similar to those herein described without departing from the inventive concepts herein. Thus, while there have been described various embodiments of the present invention, those skilled in the art will recognize that other and further changes and modifications may be made thereto without department from the spirit of the invention, and it is intended to claim all such changes and modifications that fall within the true scope of the invention. It is also understood that, as used herein and in the appended claims, the singular forms "a," "an," and "the" include plural reference, unless the context clearly dictates otherwise.

Unless defined otherwise, all technical and scientific terms used herein have the same meanings as commonly understood by one of ordinary skill in the art to which this invention belongs. While various methods and structures of the present invention are described herein, any methods or structures similar or equivalent to those described herein may be used in the practice or testing of the present invention. All references cited herein are incorporated by reference in their entirety and for all purposes. In addition, while the foregoing advantages of the present invention are manifested in the illustrated embodiments of the invention, a variety of changes can be made to the configuration, design and construction of the invention to achieve those advantages including combinations of components of the various embodiments. Hence, reference herein to specific details of the structure and function of the present invention is by way of example only and not by way of limitation.

What is claimed:

1. An apparatus for pulling a slide of a gun, comprising:

a gun having a slide and a trigger;

a slide pull having a first side and a first free end configured for being releasably coupled to one side of the slide of the gun and a second free end configured for being coupled to an opposite side of the slide of the gun;

a trigger restraint coupled to said slide pull proximate a mid-portion thereof configured for preventing movement of the trigger of the gun when positioned adjacent thereto;

whereby said slide pull is selectively moveable from a first position configured to be grasped proximate said mid-portion for pulling the slide of the gun and a second position wherein said trigger restraint abuts the trigger to prevent movement of the trigger that would cause the gun to fire.

2. The apparatus of claim 1, further comprising a pair of releasable snaps, each having a first portion attached to the slide of the gun and a second portion attached to a respective free end of said slide pull.

3. The apparatus of claim 1, wherein said first and second sides of said slide pull are formed from a laterally flexible, but laterally strong material.

4. The apparatus of claim 1, wherein said trigger restraint is comprised of a pouch formed in said slide pull and further comprising a rigid member disposed within said pouch.

5. The apparatus of claim 1, wherein said trigger restraint comprises a wedging member having a front side defining a first recess for receiving a trigger and a back side defining a second recess for receiving a grip of the gun.

6. The apparatus of claim 1, wherein said slide pull further comprises at least two releasable fasteners attached to at least one side of said slide pull to allow said trigger restraint to be held behind said trigger or in front of said trigger to prevent movement of said trigger.

7. An apparatus for pulling a slide of a handgun, comprising:

a handgun having a slide, a grip, a trigger and a trigger guard;

a pair of elongate laterally flexible members, each having first ends pivotally and releasably coupled to a respective side of the slide of the handgun, said elongate members forming a loop proximally extending from said handgun and configured for grasping by a user to pull the slide of the handgun while resisting movement of the handgun by grasping a grip of the handgun until a bullet is chambered for firing in the handgun; and a trigger restraint coupled to said pair of elongate members between proximate a second end of each of the air of elongate members.

8. The apparatus of claim 7, further comprising a first releasable fastener coupled to and between said first end of one of said pair of elongate members and a first side of the slide and to and between said second end of the other of said pair of elongate members and a second side of the slide.

9. The apparatus of claim 7, wherein said trigger restraint comprises a rigid member.

10. The apparatus of claim 7, further comprising a pair of releasable snaps, each having a first portion attached to a respective side of the slide of the gun and a second portion attached to a respective second end of one of the pair of elongate laterally flexible members.

11. The apparatus of claim 7, wherein said trigger restraint comprises a pouch and a rigid member disposed within said pouch.

12. The apparatus of claim 7, wherein said trigger restraint comprises a structure having a front side defining a first recess for receiving the trigger and a back side defining a second recess for receiving the grip of the gun.

13. A handgun, comprising:

a grip for grasping by a user;

a slide for chambering the handgun;

a trigger for firing the handgun;

a flexible slide pull having first and second ends;

a first releasable fastener having a first portion attached to the slide and a second portion attached proximate the first end of the slide pull;

a second releasable fastener having a first portion attached to the slide and a second portion attached proximate the second end of the slide pull; and said slide pull forming a loop proximally extending from said slide and configured for grasping by a user to pull the slide of the handgun toward the user while resisting movement of the handgun by grasping the grip of the handgun until a bullet is chambered for firing by the handgun.

14. The handgun of claim 13, further comprising a trigger restraint coupled to a mid-portion of said slide pull, said slide pull extending from a right side of said slide, through the trigger guard to a left side of said slide with the trigger restraint positioned at least partially within the trigger guard and against the trigger to prevent movement of the trigger and a second position in which the trigger restraint is positioned.

15. The handgun of claim 14, wherein the trigger restraint is positioned behind the trigger and is wedged behind the trigger to prevent reward movement of the trigger.

16. The handgun of claim 14, wherein the trigger restraint is positioned in front of the trigger with the trigger in a reward position to prevent forward movement of the trigger.

17. The handgun of claim 14, wherein the trigger restraint comprises a rigid member coupled to the slide pull.

18. The handgun of claim 17, wherein the slide pull comprises first and second elongate members with the trigger restraint coupled between proximal ends of the first and second elongate members.

19. The handgun of claim 13, wherein the first portion of the first releasable fastener is attached to a right side of the slide and the first portion of the second releasable fastener is attached to a left side of the slide.

20. The handgun of claim 19, wherein the first and second releasable fasteners each comprise a releasable snap comprised of the first and second portions, the first portion of each releasable snap attached to the slide and the second portion of each releasable snap attached proximate to a respective end of the side pull whereby coupling of the respective first and second portions of the first and second releasable snaps attaches the slide pull to the slide.

* * * * *